US005651471A

United States Patent [19]

Green

[11] Patent Number: 5,651,471

[45] Date of Patent: Jul. 29, 1997

[54] REMOVABLE TOP FOR DRINKING BOTTLES

[76] Inventor: Dennis E. Green, 102 Falcon Hills Dr., Highlands Ranch, Colo. 80126

[21] Appl. No.: 552,874

[22] Filed: Nov. 3, 1995

[51] Int. Cl.[6] ..... B65D 51/18

[52] U.S. Cl. ..... 220/231; 220/254; 220/336; 220/705; 215/229; 222/482; 222/545

[58] Field of Search ..... 220/709, 710, 220/231, 254, 336, 339, 367.1; 215/229, 309; 222/211, 524, 482, 545

[56] References Cited

U.S. PATENT DOCUMENTS

| | | | |
|---|---|---|---|
| 2,066,121 | 12/1936 | Morris | 215/229 |
| 3,840,153 | 10/1974 | Devlin | 215/229 |
| 3,874,554 | 4/1975 | Chang | 220/709 |
| 4,345,704 | 8/1982 | Boughton | 224/39 |
| 4,448,316 | 5/1984 | Hiroshige | 215/229 |
| 4,976,364 | 12/1990 | Solomon | 215/229 |
| 5,029,719 | 7/1991 | Solomon | 215/229 |
| 5,148,936 | 9/1992 | DeGrow | 220/254 |
| 5,244,113 | 9/1993 | Stymiest | 220/710.5 |
| 5,249,702 | 10/1993 | Topp et al. | 220/705 |
| 5,415,312 | 5/1995 | Mueller | 220/254 |

*Primary Examiner*—Joseph M. Moy
*Attorney, Agent, or Firm*—Dorr, Carson, Sloan & Birney, P.C.

[57] ABSTRACT

A removable top for use with drinking bottles has a first opening with a pop-up valve and a second opening for receiving a straw. This allows the user to either drink directly through the pop-up valve, or through a straw inserted through the straw opening with the pop-up valve serving as a vent. A removable cap can be used to seal the straw opening when it is not in use. The cap is tethered by a flexible strap to a ring around the base of the pop-up valve. The cap can be secured to a detent in the top for temporary storage when it is not being used to cover the straw opening. In one embodiment, the top is domed with the pop-up valve located at the top of the dome. The straw opening passes through a second raised collar extending upward to an elevation substantially in line with the base of the collar around the central opening. The detent is formed in the top surface of a third raised collar that also extends upward to an elevation substantially in line with the base of the collar around the central opening. This embodiment allows the cap to be easily rotated between the straw opening and the detent for storage.

20 Claims, 3 Drawing Sheets

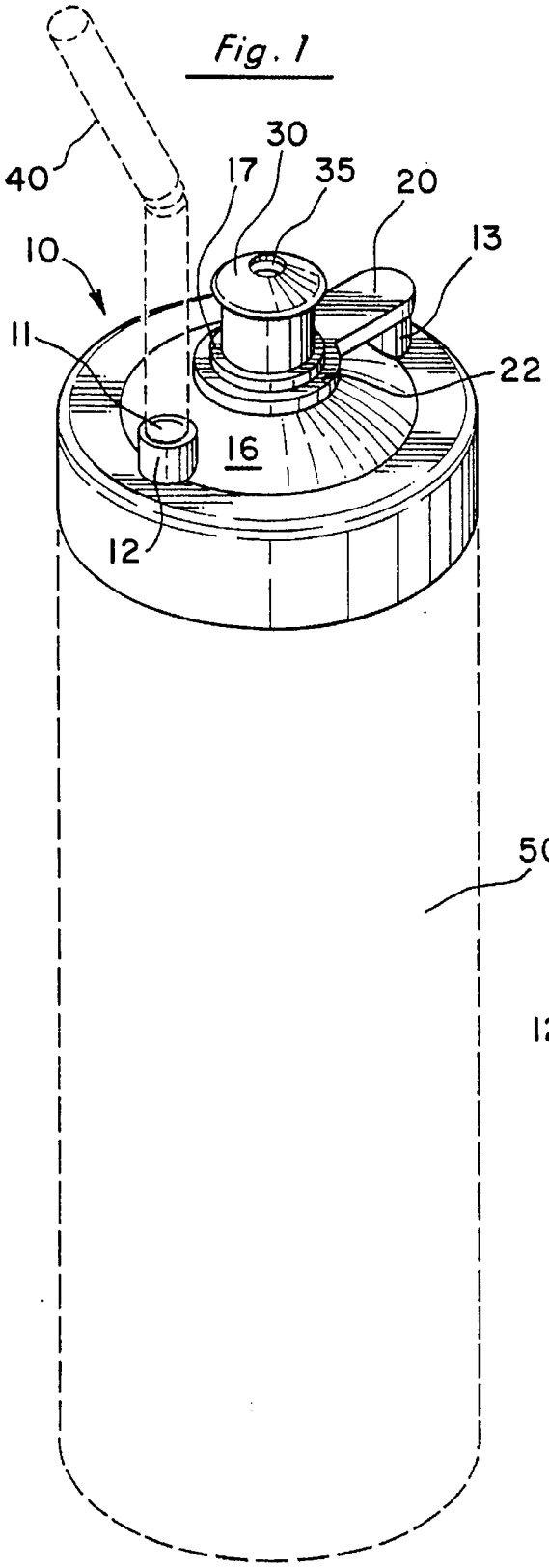
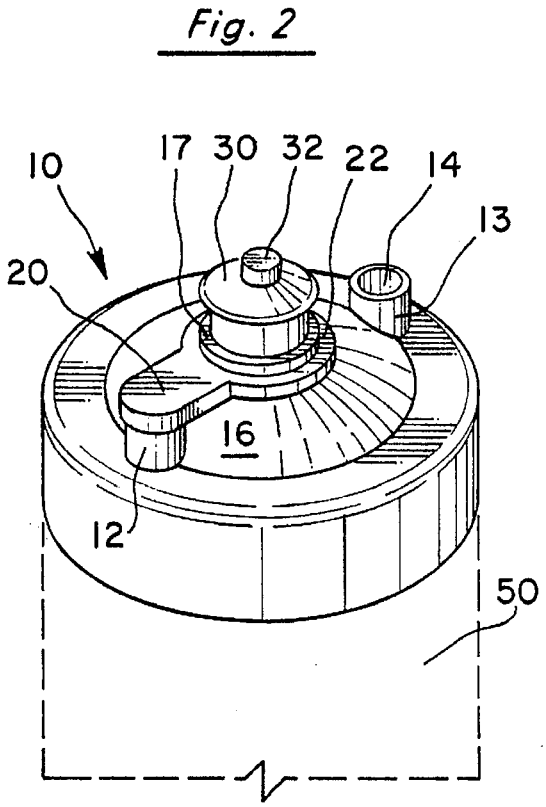
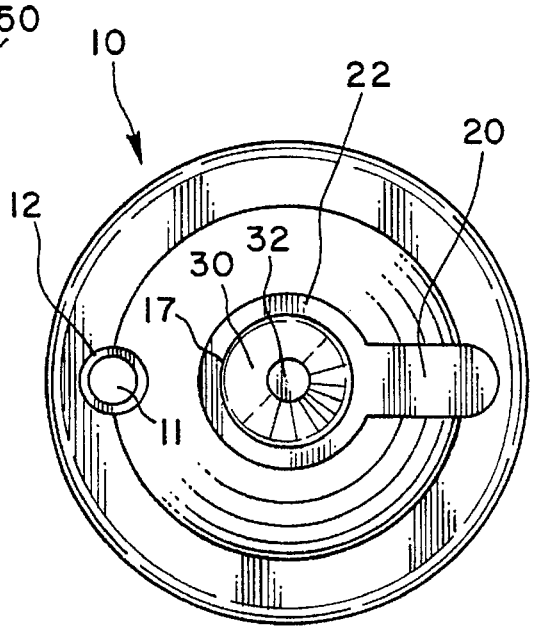
Fig. 3

REMOVABLE TOP FOR DRINKING BOTTLES

BACKGROUND OF THE INVENTION

1. Field of the Invention

The present invention relates generally to the field of drinking bottles, such as sports bottles and water bottles. More specifically, the present invention discloses a removable top for drinking bottles that includes both an opening with a pop-up valve and a second opening for a straw. The opening for the straw can be sealed by means of a cap that is tethered by a flexible strap to the base of the pop-up valve.

2. Statement of the Problem

Refillable plastic drinking bottles and containers with removable tops have been used for many years for conveniently transporting beverages. Sports bottles are convenient, reusable, flexible plastic drinking containers with screw-on or snap-on tops. The bottles are typically provided with either a flexible plastic drinking straw that extends from the outside through a hole in the top, or with a pop-up drinking spout located centrally on the plastic top.

The first general category of drinking bottle is designed for use during active participation in a sports activity, such as while bicycling, climbing, etc., and is generally known as a "sports bottle." This type is made typically from thick-walled, low-density polyethylene (0.040–0.050 inch), has a rubber like, heavy-duty feel, and does not collapse in the hand. These bottles have relatively narrow, strong necks and are often provided with a second narrow section in the mid-portion of their cylindrical body for grasping while participating in a sports activity. These bottles are designed to be used under stressful conditions and are designed with just enough flexibility to allow for fluid to be "squirted out," while otherwise maintaining their structural integrity for consistent grasping and retaining within a holder. Sports bottles of this first category are typically provided with snap-on tops containing a reclosable drinking spout, such as a pop-up valve. The drinking spout is designed to be opened and re-closed with the user's mouth so as to allow drinking while minimally interfering with an on-going activity. Sports bottles for use during physical activity were originally designed for carrying beverages while bicycling, although they now find many other uses, such as for use during hiking, jogging, and other physical activities.

The second major classification of drinking bottles is referred to as convenience bottles. These are generally designed for convenience of transporting and consuming larger amounts of beverage while at rest or on break from an activity and not for use during active sports participation. In this type of drinking bottle, more consideration is given to transporting large beverage volumes and to convenience of consumption rather than to any activities in which a consumer may be involved. Many convenience bottles are equipped with a top having a hole designed to receive a straw. Some of these are also provided with a small plastic cap tethered to the straw that can be used to cover the upper end of the straw. Other convenience bottles are equipped with a sealable spout that enables the consumer to sip the contents of the bottle.

The prior art includes a wide variety of caps for water bottles and sports bottles that have been used in the past, including the following:

| Inventor | Patent No. | Issue Date |
|---|---|---|
| Boughton | 4,345,704 | Aug. 24, 1982 |
| Solomon | 4,976,364 | Dec. 11, 1990 |
| Solomon | 5,029,719 | July 9, 1991 |
| DeGrow | 5,148,936 | Sept. 22, 1992 |
| Stymiest | 5,244,113 | Sept. 14, 1993 |
| Topp et al. | 5,249,702 | Oct. 5, 1993 |
| Mueller | 5,415,312 | May 16, 1995 |

The Solomon '719 patent shows a water bottle with a removable cap assembly that supports a drinking straw 20 inside the bottle. A protective closure cap 18 fits over the aperture above the straw. This closure cap is tethered by a flexible strap 54 to the cap hinge 28.

Topp et al. are primarily concerned with the support bracket used to hold the container. The lid includes a straw 14 extending into the container, a vent 15, and a third opening 28 that can accommodate a removable "nutrient cylinder" 33. The nutrient cylinder has a cap 37, but there is no indication that it is tethered.

The Mueller patent shows a lid assembly for a cold beverage container that has a large drinking hole 80 and a smaller hole 90 for receiving a straw. An elongated flexible stopper 100 has two end portions that can be snap-secured over the drinking and straw holes, respectively. The middle portion 120 of the stopper could be viewed as a type of tether.

The Stymiest patent discloses another example of a lid assembly for a beverage container with two openings. Again, one opening 25 is for drinking and the other opening 29 is for a straw (see FIGS. 3 and 6). Both openings are equipped with separate closures 7 and 9. The remaining references are only of passing interest.

3. Solution to the Problem

None of the prior art references shows a cap assembly with the specific combination of: (1) an opening with a pop-up valve; (2) a second opening for inserting a straw into the bottle; and (3) a cap tethered around the base of the pop-up valve that can be used to seal the straw opening. This configuration allows the user to either drink from the pop-up valve (as with a sports bottle) or use a straw inserted through the straw opening (as with a convenience bottle). When the pop-up valve is used for drinking, the cap is employed to seal the straw opening. When a straw is used for drinking, the pop-up valve serves as a vent. When the bottle is not being used for drinking, the pop-up valve can be closed and the cap can be placed over straw opening to prevent leakage from the bottle.

SUMMARY OF THE INVENTION

This invention provides a removable top for use with drinking bottles that has a first opening with a pop-up valve and a second opening for receiving a straw. This allows the user to either drink directly through the pop-up valve, or through a straw inserted through the straw opening with the pop-up valve serving as a vent. A removable cap can be used to seal the straw opening when it is not in use. The cap is tethered by a flexible strap to a ring around the base of the pop-up valve. The cap can be secured to a detent in the top for temporary storage when it is not being used to cover the straw opening. In one embodiment, the top is domed with the pop-up valve located at the top of the dome. The straw opening passes through a second raised collar extending upward to an elevation substantially in line with the base of the collar around the pop-up valve. The detent is formed in the top surface of a third raised collar that also extends upward to an elevation substantially in line with the base of the collar around the first opening. This embodiment allows the cap to be easily rotated between the straw opening and the detent for storage.

A primary object of the present invention is to provide a top for drinking bottles that allows the user to drink from either a straw or a pop-up spout.

Another object of the present invention is to provide a top for drinking bottles that includes a tethered cap that can be used to seal the straw opening when the straw is not in use, and can also be secured to the top for temporary storage when the cap is not being used to cover the straw opening.

Yet another object of the present invention is to provide a top for drinking bottles that is relatively inexpensive to mold and assemble.

These and other advantages, features, and objects of the present invention will be more readily understood in view of the following detailed description and the drawings.

BRIEF DESCRIPTION OF THE DRAWINGS

The present-invention can be more readily understood in conjunction with the accompanying drawings, in which:

FIG. 1 is a perspective view of the removable top with the cap 21 for the straw opening 11 in its stored location.

FIG. 2 is another perspective view of the top 10 with the cap 21 inserted into the straw opening 11.

FIG. 3 is atop view of the top 10 corresponding to FIG. 1.

DETAILED DESCRIPTION OF THE INVENTION

Figure 4:
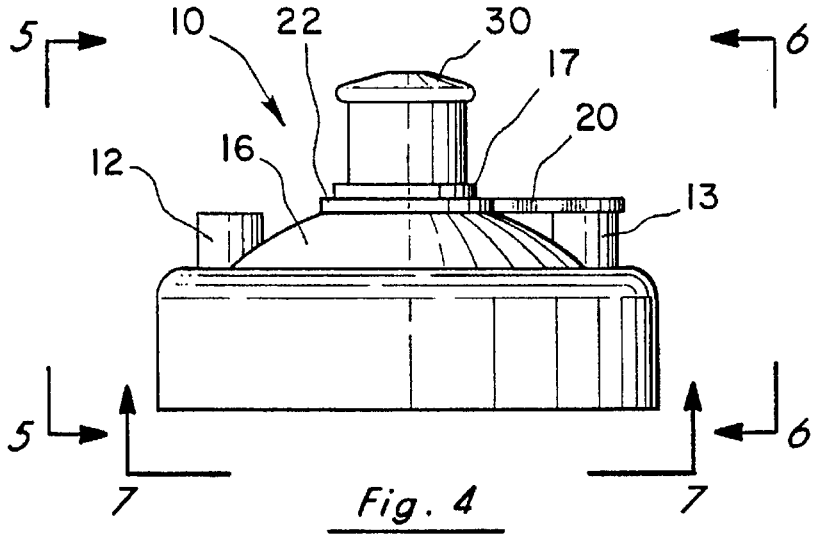
FIG. 4 is a right side view of the top 10, with the left side view being a mirror image of FIG. 4.
Figure 5:
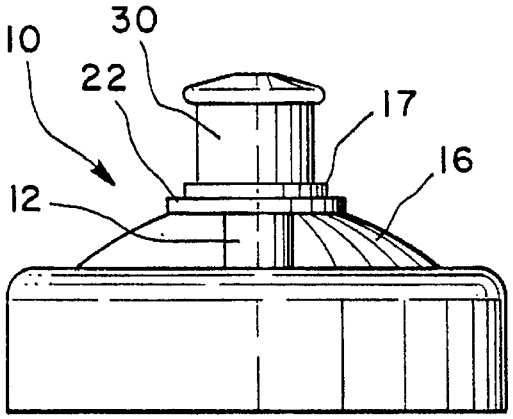
FIG. 5 is a view of the top 10.
Figure 6:
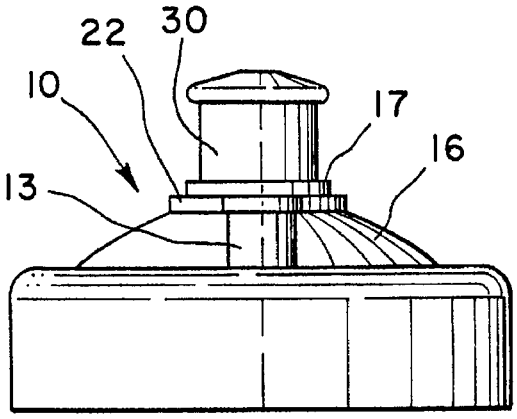
FIG. 6 is a view of the top 10.
Figure 7:
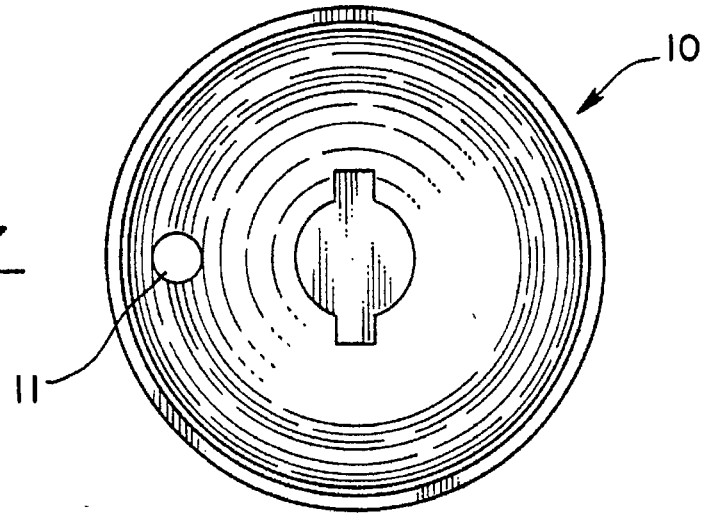
FIG. 7 is a bottom view of the top 10.
Figure 8:
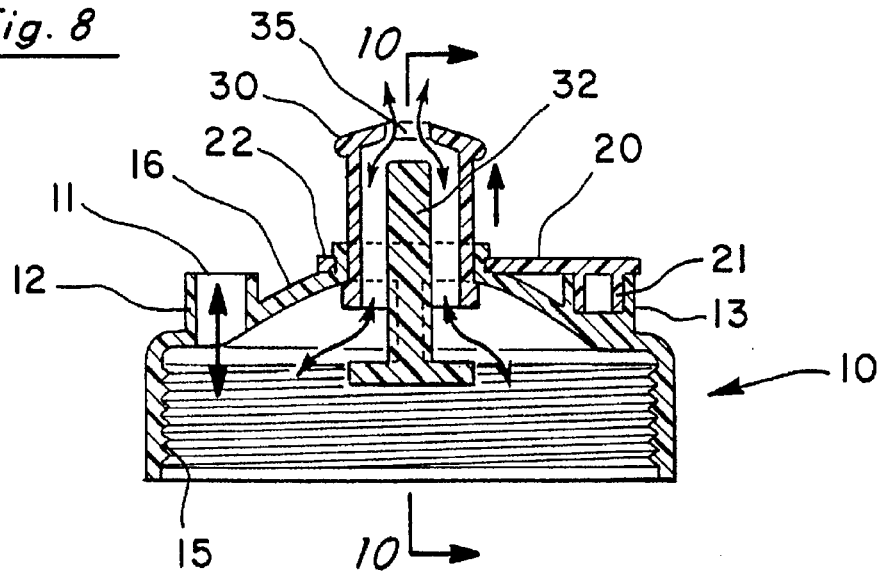
FIG. 8 is a cross-sectional view of the top 10 corresponding to FIG. 1 with the cap in its stored position and the pop-up valve 30 in its open position to serve as a vent for the straw opening 11.
Figure 9:
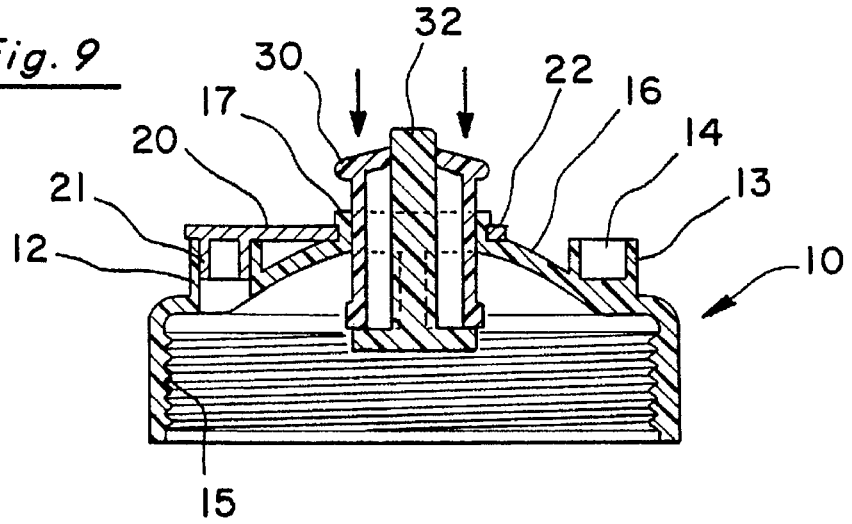
FIG. 9 is a cross-sectional view of the top 10 corresponding to FIG. 2 with the pop-up valve 30 in its closed position and the straw opening closed by the cap 21.
Figure 10:
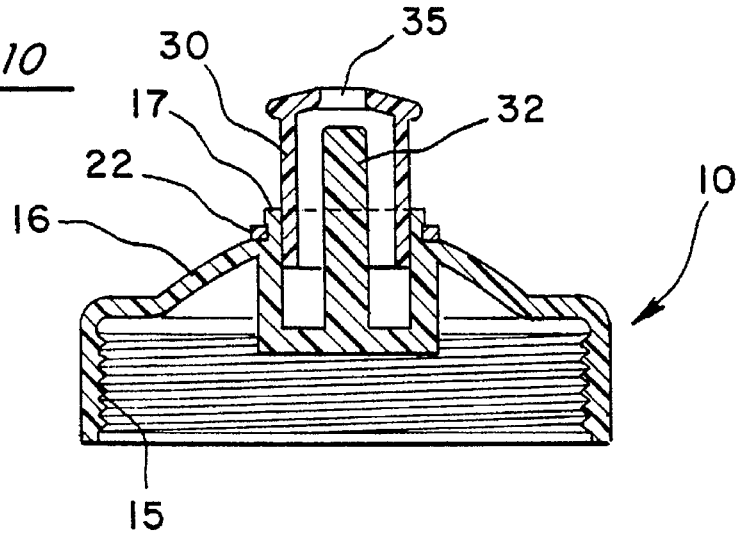
FIG. 10 is another cross-sectional view of the top 10 showing the pop-up valve 30 in its open position.

Turning to FIG. 1, a perspective view is provided showing the removable top 10 attached to a drinking bottle 50. FIG. 3 is a top view and FIG. 4 is a right side view of the top 10 corresponding to FIG. 1. Front, rear, and bottom views of the top 10 are illustrated in FIGS. 5 through 7, respectively. The top 10 includes two openings for drinking. The first opening 35, located at the center of the domed region 16 of the top 10, has a pop-up valve assembly 30 that can be raised to open the central opening 35 for drinking as shown in FIGS. 8 and 10, or depressed to seal the central opening for storage as shown in FIG. 9. When the pop-up valve 30 is depressed, the central post 32 closes the first opening as illustrated in FIGS. 2 and 9. The top 10 is removably secured to the bottle 50 by threads 15 on the underside of the top 10, as illustrated in FIGS. 8 through 10.

The second opening 11 is radially offset from the first opening 35 toward the periphery of the top 10. It has an inside diameter that is slightly larger that the outside diameter of a conventional drinking straw 40, so that a straw 40 can be inserted into the interior of the drinking bottle 50 with minimal effort. As shown in FIGS. 1 and 8, a raised cylindrical collar 12 extends upward around the straw opening 11. This collar 12 helps to support the straw 40 in an upright position and maintains a relatively snug, water-tight seal around the straw 40.

The top 10 is also equipped with a cap 21 that can be used to temporarily seal the straw opening 11 when that opening is not in use. FIG. 2 is a perspective view of the top 10 with the cap 21 inserted into the straw opening 11. Alternatively, the cap 21 can be stored while the straw opening 11 is in use by placing the cap 21 in a detent 14 in a raised cylindrical collar 13 located on the opposite side of the pop-up valve assembly 30 as depicted in FIGS. 1, 3 and 4. The detent 14 and collar 13 have approximately the same elevation and inside diameter as the collar 12 surrounding the straw opening 11 to allow the user to easily move the cap 21 between these two configurations.

The cap 21 can have any of a number of possible embodiments. For example, the cap 21 shown in the drawings is a plug that can be inserted into either the straw opening 11 or the detent 14. Alternatively, the cap 21 could be enlarged to fit over the entire collar 12 surrounding the straw opening. The detent 14 would no longer be necessary in this embodiment since the cap 21 would also fit over the entire third collar 13 for storage. In this embodiment, the third collar 13 would serve as the means for removably securing the cap 21 to the top 10 while the straw opening 11 is in use.

In the preferred embodiment, the pop-up valve assembly 30 extends upward from the highest portion of the dome 16 with a short cylindrical collar 17 at its base surrounding the first opening. The cap 21 is tethered by a flexible strap 20 to a ring 22 that is secured around this central collar 17. The pop-up valve 30 slides up and down relative to this central collar 17 and retains the ring 22 on the central collar 17. In the embodiment depicted in the drawings, the pop-up valve 30 slides inside the central collar 17. However, the pop-up valve 30 could be sized to slide over the central collar 17 and thereby retain the ring 22 in place. The cap 21, strap 20, and ring 22 can be molded in one piece of flexible plastic to minimize manufacturing costs. The collar 12 around the straw opening 11 extends upward to an elevation substantially in line with the base of the central collar 17 around the pop-up valve 30, as does the other collar 13 used for storing the cap 21. Both collars 12 and 13 are roughly equidistant from the pop-up valve 30 so that the cap 21 can be easily rotated between these two collars 12 and 13 by rotating the ring 22 around the central collar 17 of the pop-up valve assembly 30. The equal elevations of the ring 22 and two collars 12, 13 help to minimize any tendency that the ring 22 and strap 20 might have to exert an upward force on the cap 21, and thereby dislodge the cap 21 from either the straw opening 11 or the detent 14 in the opposing collar 13 used for storing the cap 21.

These components allow the top 10 and bottle 50 to be used in several configurations as illustrated most clearly in FIGS. 1 through 3 and 8 through 10. FIG. 1 shows the top 10 with the pop-up valve assembly 30 in its open position to serve as a vent while the user drinks through a straw 40 inserted through the straw opening 11. The cap 21 is temporarily stored in the detent associated with the raised collar 13. FIGS. 2 and 9 show a second configuration in which the pop-up valve assembly 30 is closed and the straw opening 11 is closed by the cap 21. This second configuration would normally be used while the bottle is being to transported so that the beverage cannot readily leak out of the bottle. FIGS. 3 and 8 show another configuration in which both the pop-up valve 30 and the straw opening 11 are open. This third configuration allows the user to drink from the pop-up valve 30 while the straw opening 11 serves as a vent.

The above disclosure sets forth a number of embodiments of the present invention. Other arrangements or embodiments, not precisely set forth, could be practiced under the teachings of the present invention and as set forth in the following claims.

I claim:

1. A removable top for use with drinking bottles comprising:

a first opening extending through said top;

a pop-up valve assembly for manually opening and closing said first opening;

a second opening extending through said top for receiving a straw;

a cap for removably sealing said second opening; and means for tethering said cap to said pop-up valve assembly.

2. The removable top of claim 1 further comprising means for removably securing said cap to said top when said cap is not used to seal said second opening.

3. The removable top of claim 2 wherein said means for removably securing said cap to said top comprises a detent in the surface of said top.

4. The removable top of claim 1 wherein said cap comprises a plug for sealing said second opening.

5. The removable top of claim 1 wherein said tether means comprise:

a ring around said pop-up valve assembly; and a flexible strap extending from said ring to said cap.

6. The removable top of claim 5 wherein said pop-up valve assembly further comprises a first collar extending upward from said first opening and through said ring, and wherein said pop-up valve slides relative to said first collar and retains said ring on said first collar.

7. The removable top of claim 5 wherein said cap, strap, and ring are formed as a single piece of flexible plastic.

8. The removable top of claim 1 wherein said top is domed with a first collar extending around said first opening at the highest portion of said dome, and said second opening has a second collar extending upward to an elevation substantially in line with the base of said first collar around said first opening.

9. The removable top of claim 8 further comprising a third collar extending upward to an elevation substantially in line with the base of said first collar around said first opening for removably securing said cap to said top when said cap is not used to seal said second opening.

10. A removable top for use with a drinking bottle comprising:

a first opening extending through said top;

a first collar surrounding said first opening;

a pop-up valve for manually opening and closing said first opening;

a second opening extending through said top for receiving a straw;

a cap for removably sealing said second opening;

a ring around said first collar;

a flexible strap extending from said ring to said cap; and means for removably securing said cap to said top when said cap is not used to seal said second opening.

11. The removable top of claim 10 wherein said means for removably securing said cap to said top comprises a detent in the surface of said top.

12. The removable top of claim 10 wherein said cap comprises a plug for sealing said second opening.

13. The removable top of claim 10 wherein said pop-up valve slides relative to said first collar and retains said ring on said first collar.

14. The removable top of claim 10 wherein said cap, strap, and ring are formed as a single piece of flexible plastic.

15. The removable top of claim 10 wherein said top is domed with said first collar extending around said first opening at the highest portion of said dome, and said second opening has a second collar extending upward to an elevation substantially in line with the base of said first collar around said first opening.

16. The removable top of claim 15 further comprising a third collar extending upward to an elevation substantially in line with the base of said first collar around said first opening, and wherein said means for removably securing said cap to said top comprises a detent in said third collar.

17. A removable top for use with a drinking bottle comprising:

a first opening extending through said top;

a first collar surrounding said first opening;

a pop-up valve for manually opening and closing said first opening;

a second opening extending through said top for receiving a straw;

a cap for removably sealing said second opening;

a ring around said first collar;

a flexible strap extending from said ring to said cap;

a second collar extending upward around said second opening to an elevation substantially in line with said ring around said first collar;

a third collar extending upward from said top to an elevation substantially in line with said ring around said first collar; and a detent in said third collar for removably securing said cap to said third collar when said cap is not used to seal said second opening.

18. The removable top of claim 17 wherein said top is domed with said first collar extending around said first opening at the highest portion of said dome.

19. The removable top of claim 17 wherein said pop-up valve slides relative to said first collar and retains said ring on said first collar.

20. The removable top of claim 17 wherein said cap, strap, and ring are formed as a single piece of flexible plastic.

* * * * *